United States Patent [19]

Barton

[11] 4,022,476

[45] May 10, 1977

[54] GOLF PRACTICE DEVICE

[76] Inventor: C. Dickinson Barton, c/o Barton Industries, 236 W. 54th St., Kansas City, Mo. 64112

[22] Filed: June 14, 1976

[21] Appl. No.: 695,830

Related U.S. Application Data

[63] Continuation-in-part of Ser. No. 626,848, Oct. 29, 1975, abandoned.

[52] U.S. Cl. ..... 273/185 C; 273/185 D; 273/58 C; 273/199 A; 273/200 R; 224/5 D

[51] Int. Cl.[2] ..... A63B 69/36; A63B 43/00

[58] Field of Search ..... 273/184 B, 185 C, 185 D, 273/26 E, 26 EA, 197 R, 197 A, 58 D, 58 C, 199 R, 199 A

[56] References Cited

UNITED STATES PATENTS

| | | | |
|---|---|---|---|
| 1,907,412 | 5/1933 | Zimmer | 273/200 A |
| 1,940,033 | 12/1933 | Von Schlegell | 273/197 R X |
| 2,402,274 | 6/1946 | Clarke | 273/185 D |
| 2,432,714 | 12/1947 | Bedard | 273/200 R |
| 2,470,807 | 5/1949 | Davis | 273/184 B |
| 3,837,654 | 9/1974 | Hall | 273/200 B |

*Primary Examiner*—George J. Marlo
*Attorney, Agent, or Firm*—Lowe, Kokjer, Kircher, Wharton & Bowman

[57] ABSTRACT

A golf practice device includes a solid golf ball which is mounted within a thin net of cords carried on the bottom end of a flexible cable. A spring connects to the top end of the cable to absorb the force when the ball is struck. The top end of the spring and cable assembly is supported to swing about the lower leg of a crank arm. The upper leg of the crank arm is supported for rotation on the frame of the device so that when the ball is hit the impact force is distributed between the cable and the crank arm. A pair of cord ends which hang below the ball drag on the ground to quickly stabilize the ball in hitting position for the next stroke.

11 Claims, 7 Drawing Figures

GOLF PRACTICE DEVICE

BACKGROUND AND SUMMARY OF THE INVENTION

This application is a continuation-in-part of my earlier application Ser. No. 626,848, filed Oct. 29, 1975, now abandoned.

This invention relates to a device that provides practice in the use of golf clubs.

There have been various types of devices developed in the past to aid golfers in practice exercises. In constructing equipment of this type, a primary consideration is to stimulate as much as possible actual golf playing conditions. However, many of the existing golf practice devices utilize a hollow plastic ball which does not give the golfer the same "feel" as striking a solid golf ball. This type of device is thus largely unsatisfactory because the golfer is not able to determine whether the ball has been struck properly, or whether a shot has been hit that would result in the fading or drawing of the ball.

Existing golf practice devices typically mount the ball on a cable or the like that is supported to swing about its top end on an arm or other support. When the ball is struck, the cable receives the entire impact force and is therefore subjected to excessive wear which necessitates its frequent replacement. This significantly increases the costs involved and the inconvenience to the user. In addition, the cable or other ball support is susceptible to failure which is dangerous since the ball is hit with a great deal of force. The considerable time that it takes for the cable to stop oscillating and return the ball to hitting position for the next stroke further inconveniences the user.

In those devices that employ a solid golf ball, it has been typical for the ball to be bored or otherwise pierced or derformed to a certain extent in order to mount it on the end of the cable. This not only detracts from the "feel" of the ball but also makes the ball highly susceptible to being split. Consequently, the ball must often be replaced and this further adds to the cost and inconvenience involved, as well as to the safety problems.

It is an important object of the present invention to provide a golf practice device which substantially simulates actual playing conditions.

It is another object of the invention to provide a practice device which is adapted for use either indoors or outdoors and which may be used by either a right or left handed golfer.

A further object of the invention is to provide a practice device which minimizes the wear on the parts, particularly the wear on the cable on which the ball is carried.

Yet another object of the invention is to provide a golf practice device which utilizes a solid golf ball without requiring the ball to be bored or otherwise pierced or deformed.

An additional object of the invention is to provide a golf practice device which permits the golfer to determine the type of spin that has been imparted to the ball.

A still further object of the invention is to provide a golf practice device which includes means for quickly stabilizing the ball in hitting position for the next stroke.

Yet another object of the invention is to provide a golf practice device having improved safety characteristics in comparison to prior art devices.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 5:
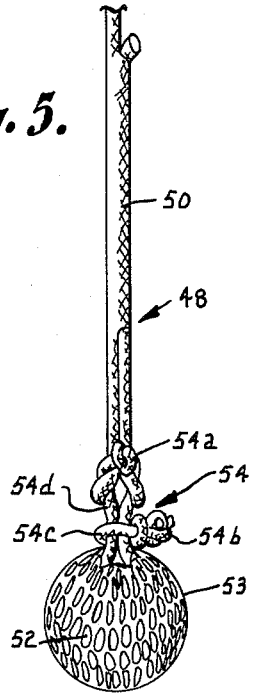
FIG. 5 is a fragmentary elevational view similar to FIG. 4, but illustrating an alternative means by which the ball may be mounted.
Figure 6:
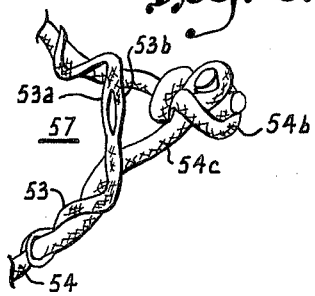
Figure 7:
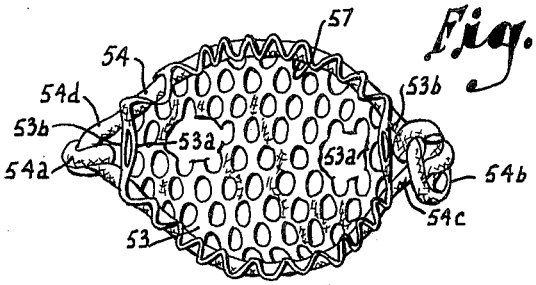

FIG. 6 is an enlarged fragmentary plan view illustrating the ball holding net shown in FIG. 5 at the area thereof where one of the cord loops passes out of the net, with the net in an open or loose condition in which the ball may be inserted or removed; and FIG. 7 is a top plan view of the net shown in FIG. 5 and 6, with the net in an open or loose condition in which the ball may be inserted or removed.

Figure 1:
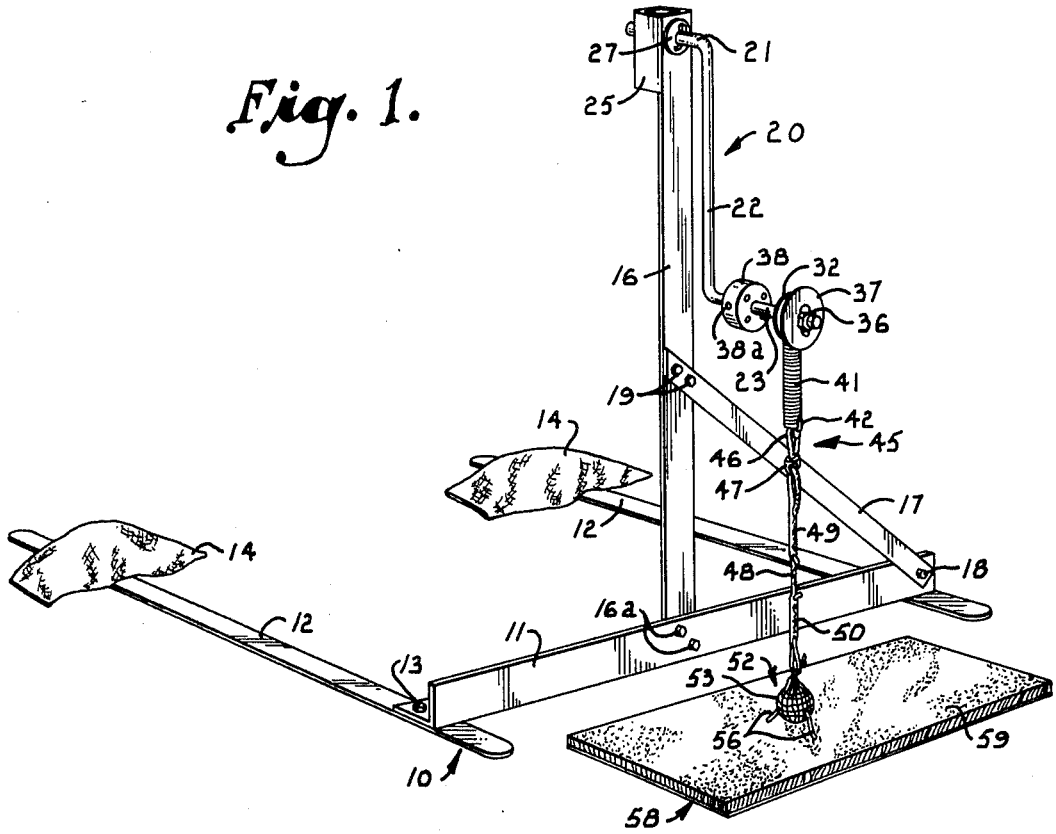
FIG. 1 is a perspective view illustrating a golf practice device constructed according to the invention.

Referring to the drawings in detail and initially to FIG. 1 in particular, a golf practice device constructed according to the invention includes a base generally designated by reference numeral 10. The base 10 supports the device on the ground when used outdoors and on the floor when used indoors. The base includes a forward horizontal angle member 11 which extends between a pair of spaced horizontal legs 12. Each leg 12 is connected near its forward end to one end of member 11 by a bolt 13. Legs 12 are relatively long, flat members which extend perpendicularly to the rear of member 11 in order to provide a large, stable base for the practice device. Each leg 12 is able to be pivoted inwardly about its bolt 13 so that the legs may be folded beneath member 11 when the device is not in use. This permits the device to be easily carried and to take up little room when stored.

A pair of weighted bags 14 may be placed on legs 12 near the rearward ends of the legs in order to further stabilize the base and prevent it from raising or otherwise moving during use. It is also contemplated that legs 12 may be provided with openings (not shown) which receive stakes (also not shown) that are driven into the ground to firmly set the base in place during outdoor use. In addition, legs 12 may be secured to a cement or tile surface by two sided industrial tape.

An upright post 16 is secured at its bottom end to the center of member 11 by a pair of nut and bolt assemblies **16*a*. Post 16 is in the form of an angle with its forward flange bolted at 16*a* to the vertical forward flange of member 11. A brace 17 angles from one end of member 11 to an intermediate location on post 16. A bolt assembly 18 secures the lower end of brace 17** to member 11, and bolt assemblies 19 secure the upper end of the brace to post 16.

A crank shaped arm 20 is supported for rotation at the upper end of post 16. Arm 20 includes an upper horizontal portion 21, a vertical portion 22 which extends downwardly from the outer end of portion 21, and a lower horizontal portion 23 which extends outwardly from the lower end of portion 22 in parallel realtion to portion 21. The portions 21 and 23 of arm 20 are cylindrical in cross-section.

Figure 3:
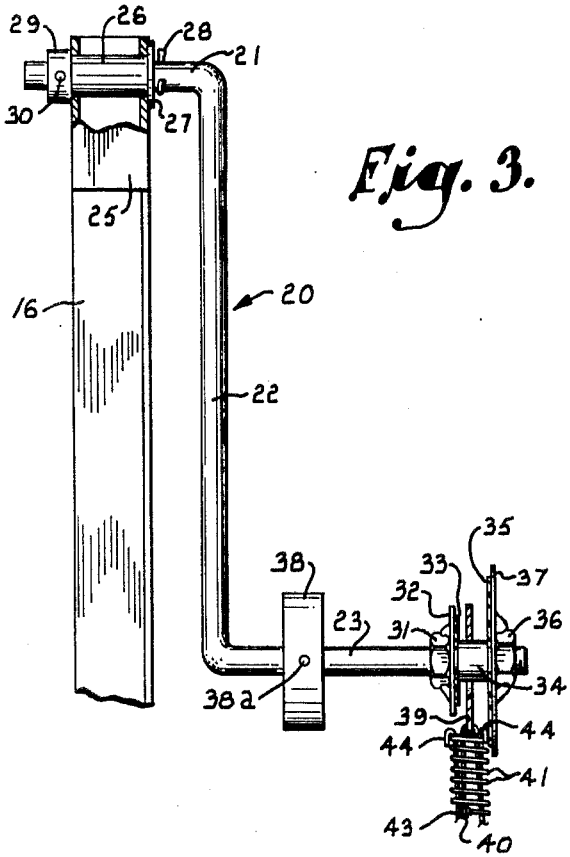
FIG. 3 is a fragmentary side elevational view on an enlarged scale illustrating in detail the crank arm and parts assembled thereto, portions being shown in cross section.

With particular reference to FIG. 3, a short angle section 25 is secured to the top end of post 16. The edges of the flanges of angle 25 are welded to the edges of the flanges of post 16 in order to form a hollow box-like structure. A sleeve-like bearing 26 is mounted to extend horizontally from front to rear within the box structure. The forward end of bearing 26 is fitted in an opening in the forward flange of post 16, and the rearward end of the bearing is likewise fitted in an opening in the rear flange of angle 25.

The upper horizontal portion 21 or arm 20 is received in bearing 26 for rotation. A washer 27 encircles arm portion 21 and is located adjacent the forward surface of post 16 by a cotter pin 28. A collar 29 is secured on arm portion 21 at a location adjacent the rear surface of angle section 25 by a set screw 30. Washer 27 and collar 29 cooperate to prevent arm portion 21 from sliding laterally in bearing 26. Arm portion 21 preferably extends forwardly of post 16 a distance sufficient to space vertical portion 22 at least one inch from the post.

With continued reference to FIG. 3, the lower arm portion 23 is threaded on its outer end. A nut 31 to which washer 32 is welded is threaded onto arm portion 23 to a position well inwardly of the end of the arm portion. A smaller washer 33, preferably formed of resilient material, is fit over arm portion 23 and positioned adjacent washer 32. A tubular sleeve 34 having a smooth exterior surface is placed on arm portion 23 with its inward end bearing against washer 33. Another washer 35 which is preferably formed of a resilient substance is positioned over the arm portion and against the outer end of sleeve 34. Finally, a nut 36 to which a large disc 37 is welded is threaded onto the end of arm portion 23 to retain sleeve 34 in place between washers 33 and 35.

A weighted disc 38 is mounted on arm portion 23, preferably at a location approximately midway of the length of the arm portion. A set screw 38*a* is threaded through disc 38 and tightened against arm portion 23 to secure the disc in place.

Sleeve 34 provides a rotative support for a ring 39 that is loosely fit over the sleeve. The central opening of ring 39 is considerably larger than the diameter of sleeve 34 to thereby permit the ring to freely rotate about the axis of the sleeve. Ring 39 is thin and flat and is able to move on the sleeve between washers 33 and 35.

The upper end of an elongated, generally inverted U-shaped bracket 40 is hooked through an aperture in ring 39. Bracket 40 hangs freely from the washer and includes a pair of parallel, rod-like legs which extend vertically within a compression spring 41. The lower ends of the legs of bracket 40 are formed with hooks 42 (FIG. 1) which are hooked around the lower end of compression spring 41 to support the spring.

Another U-shaped bracket 43 (FIG. 3) identical to bracket 40 but inverted relative thereto also extends vertically within spring 41. The upper ends of the rod-like legs of bracket 43 are provided with hooks 44 which are hooked over the upper end of spring 41 to suspend bracket 43 within the spring. The lower U-shaped end of bracket 43 projects below the bottom end of spring 41.

As best illustrated in FIG. 1, a swivel connection 45 is mounted on the lower end of bracket 43. The swivel 45 includes an upper hook element 46 which is removably hooked to the lower end of bracket 43. The base of swivel 45 is rotatable relative to hook element 46 and includes a ring 47 from which a cable 48 is suspended.

Figure 4:
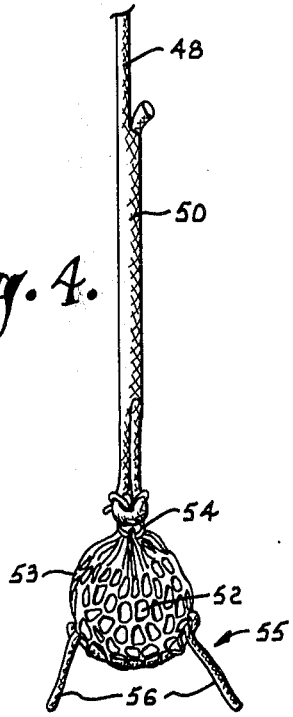
FIG. 4 is a fragmentary elevational view on an enlarged scale illustrating in detail the manner in which the golf ball is mounted.

Cable 48 is preferably constructed of a strong flexible material such a polyethylene, nylon, or the like which is also rather stiff to prevent the cable from winding around arm 20 or any part of the frame. The cable is formed from a number of strands which are interwoven in a manner to provide a tube-like arrangement of substantial strength. Upper and lower portions 49 and 50 are formed intermediately on cable 48 by providing lateral openings through which the ends of the cable may be threaded. As shown in FIG. 1, the top end of the cable is looped through ring 47 and drawn back through the opening to the interior of portion 49 to secure the cable to swivel 45. The end of the cable may be fused to enlarge it and thereby prevent it from passing back through portion 49. A loop is also formed in the lower end of the cable by looping the end of the cable and passing it back through the opening of portion 50, as best shown in FIG. 4. The lower end of the cable may also be fused to prevent it from passing back through area 50. The length of cable 48 may be adjusted by manipulating its free ends to vary the size of the loops at the upper and lower ends of the cable.

Referring to FIG. 4 in particular, a standard golf ball 52 is supported from the lower end of cable 48. The golf ball is contained within a thin flexible net 53 which is preferably formed of thin, tough synthetic fibers (such as nylon) woven together in an openwork pattern. The net 53 is wrapped completely around the gold ball, and a cord 54 is threaded through the net at the top portion thereof and knotted to secure the net tightly around the ball. Cord 54 is preferably looped so that the lower loop of cable 48 may be passed through the cord loop, passed around ball 52, and tightened with the cord loop to securely mount the ball on cable 48. This manner of connecting cord 54 with cable 48 permits easy replacement of the ball and net assembly because the cord 54 of the used assembly may be cut and a new assembly mounted as indicated above.

A flexible cord 55 is threaded through the bottom portion of net 53 and lies against the underside of ball 52. The opposite ends 56 of the cord hang downwardly below the golf ball in order to drag on the grass and thereby stabilize the ball in hitting position.

FIGS. 5–7 illustrate an alternative manner for supporting the ball 52. The net 53 is a bag or sack shaped member which may be opened at the top to present an opening 57 which is of sufficient size to receive ball 52. A length of cord 54 is threaded around opening 57 through the mesh openings of the net with a knot 54*a* tied at the mid-point. The cord ends are knotted as at 54*b* to form loop portion 54*c* of the cord which projects outwardly from net 53. Another loop 54*d* in the cord projects away from the net at a location diametrically across opening 57 from loop 54*c*. Loop 54*d* carries the knot 54*a*.

Net 53 is preferably treated with a latex solution in order to prevent it from unraveling and to increase its strength. Reinforcement is provided in the net at the areas of the loops 54*c* and 54*d*. As shown in FIG. 6, the edge portions of net 53 on the periphery of opening 57 are folded or doubled over on themselves at the locations at which loops 54*c* and 54*d* project from the net. An inner ply 53*a* and an outer ply 53*b* are thereby formed which lie against one another and which are retained in their folded over condition by the cord 54 which passes through the aligned mesh openings of the two plies. In this manner, net 53 is strengthened at the locations where loops 54*c* and 54*d* extend from the net, which locations are the portions of the net that bear the majority of the forces.

With ball 52 inserted in the net through opening 57, the two cord loops 54*c* and 54*d* may be drawn tightly to close opening 57 and to stretch the net tightly around the ball.

Loop 54*d* is then passed through loop 54*c*, drawn tightly, and attached to the loop on the lower end of cable 48, as shown in FIG. 5. To accomplish this, the lower loop portion of cable 48 is passed through loop 54*d*, passed around ball 52, and tightened in order to attach firmly to cord 54. This manner of mounting the ball assures that loop 54*d* bears the majority of the forces when the ball is hit, rather than the other loop 54*c* in which the ends of cords 54 are tied together. Also, net 53 is held tightly around the ball so that the ball may be struck without detracting significantly from its feel. Ball 52 may be removed from the net by removing the net assembly from cable 48 and loosening cord 54 to expand opening 57 such that the ball may be withdrawn from the net.

Figure 2:
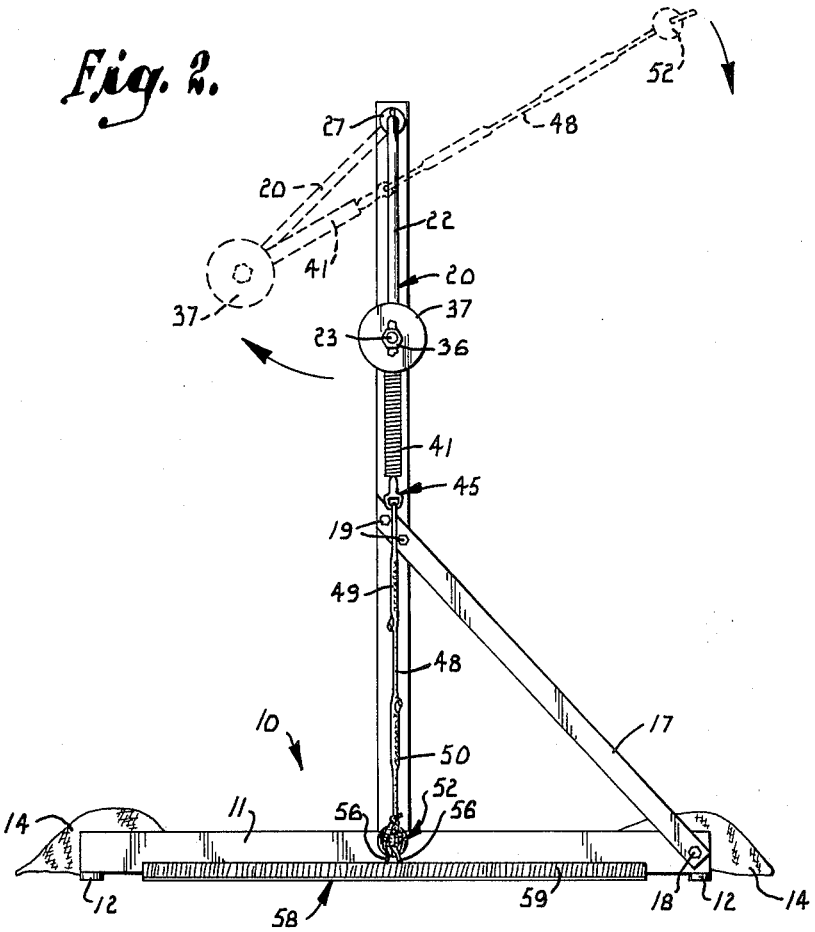
FIG. 2 is a front elevational view of the device shown in FIG. 1, with the broken lines indicating a typical positioning of the parts after the ball has been hit.

A mat 58 (FIGS. 1 and 2) is preferably used with the device indoors. The mat 58 is provided with synthetic grass 59 in order to simulate the grass surface from which golf balls are hit under actual playing conditions. As shown in FIG. 2 it is contemplated that ball 52 will be spaced slightly above the upper surface of the synthetic grass at the height at which the ball would be placed if on a tee. Alternatively, the ball may rest on the grass surface much as it would in a normal fairway lie. The height of the ball may be easily adjusted by manipulating one of the free ends to vary the size of the corresponding loop of cable 48 and thus change the length of the cable in accordance with the desired height of the ball.

In use, the device provides golfing practice either indoors or outdoors. FIG. 1 illustrates indoor use where mat 58 is employed, although it is to be understood that a rug or the like (not shown) may instead be used indoors, and that the ball may be positioned adjacent the ground during outdoor use.

With the golf ball 52 in hitting position as shown in FIG. 1 and the solid lines in FIG. 2, the golfer addresses the ball and takes his normal swing with either a wood club or an iron club. The broken lines and directional arrows in FIG. 2 show the movement of the golf ball and arm 20 when the ball is hit by a right handed golfer. The impact force imparted to cable 48 is absorbed to a large extent by spring 41 which compresses when the ball is hit. The hitting force on the ball not only rotates ring 39 clockwise on sleeve 34, but also acts on crank arm 20 to pivot the arm clockwise about the axis of its upper portion 21. As a result, the hitting force is distributed between cable 48 and arm 20 so that the cable does not receive the entire force. The weight 38 absorbs a large amount of the hitting energy and thus prevents arm 20 from pivoting excessively. When hit hard by an average golfer, golf ball 52 will swing on cable 48 completely around the axis of the lower arm portion 23, while arm 20 will not make a complete revolution but instead will pivot only to the approximate position shown in broken lines in FIG. 2. Since the points at which arm 20 and cable 48 are supported are laterally offset from one another, the crank arm and cable will not interfere with one another as they move. Also, the stiffness of cable 48 prevents it from winding around arm 20 or the frame structure.

When the ball has made a complete revolution about the axis of arm portion 23, the flexible cord ends 56 engage the grass to reduce the speed of the ball and prevent it from swinging excessively. Due to the dragging of the cord ends 56, the ball will not oscillate back and forth for a considerable time as it otherwise would. Ball 52 is thus quickly returned to hitting position (FIG. 1) and it may be immediately addressed for the next stroke.

Since ball 52 is entirely supported by the net 53, the ball need not be bored or otherwise pierced in order to mount it. The thin, tightly wrapped net does not detract from the feel of the solid golf ball to any appreciable extent, and the golfer is thus able to feel whether or not the ball has been struck solidly. Since the extent to which arm 20 pivots is proportional to the force with which the ball is hit, observance of the height to which arm 20 is raised gives an indication of how hard the ball has been struck.

Since the swivel connection 45 permits the ball to spin, the golfer is able to determine, by observing whether the cord ends 56 spin, whether he has imparted spin to the ball that would result in a hooked or sliced shot. Also, he can visually note whether the path of the ball is on a plane inclined from vertical and thus whether the ball has been struck in an inside-out or outside-in manner.

It is pointed out that since spring 41 is a compression spring that is compressed when the ball is hit, it does not deform permanently as would be the case with a tension or expansion spring that would be permanently stretched after prolonged use. It is also noted that the ball support assembly provides a spring 41, a resilient cable 48, a sturdy net 53 and cord 54, and various loop arrangements which cooperate with one another and with arm 20 and weight 38 to absorb the force when the ball is struck. These members are strong enough so as not to fail even after the ball has been struck repeatedly.

The resilient members, loop connections, and crank arm which cooperate to support the ball are important in achieving safety since they absorb the considerable force of the hitting stroke while being strong enough not to fail even after prolonged use. Also, the disc 37 prevents spring 41 from angling toward the golfer at an angle greater than approximately 15° from vertical, which assures that the ball will not strike the golfer. Since the only portion of the ball support assembly that is able to swing toward the golfer is the portion below the top of cable 48 and this portion is shorter than the distance that the golfer stands from the ball, there is no possibility of the ball swinging against the golfer.

While the device of the present invention has been illustrated and described as a device for use in practicing a golf swing, it should be apparent that it can be easily modified for use in practicing the swinging of a baseball bat, tennis racket, or other club which is used to hit a ball with considerable force.

From the foregoing, it will be seen that the invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Apparatus for use to practice striking a ball, said apparatus comprising:

support means for supporting the apparatus on a surface;

a frame member on said support means extending above the surface;

an arm member bent in a manner to provide upper and lower end portions that are vertically and horizontally offset from one another, said upper end portion being supported on said frame member to pivot about a first substantially horizontal axis;

a vertically oriented suspension member supported on the lower end portion of said arm member to swing about a second substantially horizontal axis offset from and parallel to said first axis;

a ball; and means for mounting said ball on said suspension member at a location below said second axis.

2. Apparatus as set forth in claim 1, wherein said arm member comprises a crank arm having said upper and lower end portions extending parallel to one another, said crank arm including an intermediate portion interconnecting said upper and lower end portions.

3. Apparatus as set forth in claim 1, including drag means extending below said ball for dragging on said surface to assist in stabilizing said ball in a stationary position.

4. Apparatus as set forth in claim 3, wherein said drag means includes a flexible drag element extending below said ball.

5. Apparatus as set forth in claim 1, wherein said ball is a solid golf ball and said ball mounting means includes a ball support member drawn around the golf ball and supported on said suspension member.

6. Apparatus as set forth in claim 1, wherein said ball mounting means includes a net wrapped tightly around said ball and supported on said suspension member.

7. Apparatus as set forth in claim 6, including a drag element supported on said net and extending below said ball to drag on said surface.

8. Apparatus as set forth in claim 1, wherein said suspension member includes a flexible member and a spring coupled to said flexible member to absorb the force exerted on said flexible member.

9. Apparatus as set forth in claim 8, wherein said spring is a compression spring.

10. Apparatus as set forth in claim 1, including a weighted member mounted on the lower end portion of said arm member.

11. Apparatus as set forth in claim 1, wherein said support means includes a base adapted to rest on the surface, said base including a pair of horizontal legs and a horizontal cross member extending between said legs, said legs being foldable to positions substantially parallel to said cross member in close proximity thereto.

* * * * *